United States Patent [19]

Feinstein, Jr. et al.

[11] 3,981,497

[45] Sept. 21, 1976

[54] AUTOMATIC DOCUMENT ALIGNMENT METHOD AND APPARATUS FOR DOCUMENT FEED EQUIPMENT

[75] Inventors: Paul Feinstein, Jr.; Gary Leo Sokol, both of Austin, Tex.

[73] Assignee: International Business Machines Corporation, Armonk, N.Y.

[22] Filed: June 23, 1975

[21] Appl. No.: 589,301

[52] U.S. Cl. ..... 271/126; 271/110; 271/114; 271/117; 271/153; 271/10

[51] Int. Cl.[2] ..... B65H 3/06; B65H 5/06; B65H 7/14

[58] Field of Search ..... 271/34, 110, 111, 114, 271/116, 117, 126, 152–156, 10

[56] References Cited

UNITED STATES PATENTS

| | | | |
|---|---|---|---|
| 1,109,902 | 9/1914 | Cross | 271/111 |
| 1,183,629 | 5/1916 | Broadmeyer | 271/153 |
| 3,514,089 | 5/1970 | Ostwald | 271/110 |
| 3,549,255 | 12/1970 | Umahashi et al. | 271/259 |

FOREIGN PATENTS OR APPLICATIONS

| | | | |
|---|---|---|---|
| 351,987 | 3/1961 | Switzerland | 271/152 |
| 1,122,627 | 8/1968 | United Kingdom | |

OTHER PUBLICATIONS

"Document Elevating Hopper" Habich et al.; IBM Technical Disclosure Bulletin, vol. 17, No. 7; Dec. 1974.

"Cut Sheet Feed Device" Rogers; IBM Technical Disclosure Bulletin; vol. 14, No. 5; Oct. 1971.

*Primary Examiner*—Robert W. Saifer
*Attorney, Agent, or Firm*—John L. Jackson

[57] ABSTRACT

Disclosed is document feed apparatus including a cooperating roller assembly for separating and feeding individual documents from a stack to utilization apparatus, the roller assembly including rotatably powered separator, restraint, and picker rollers, the picker roller being mounted to pivot out of and into engagement with the document stack. Control means responsive to each document passing through the roller assembly lifts and drops the picker roller from and into engagement with the stack, the momentum of the dropping picker roller assembly effective to switchably actuate motive means for incrementally elevating a vertically movable document support platform to continually reposition the top of the document stack in alignment with the roller assembly.

3 Claims, 5 Drawing Figures

AUTOMATIC DOCUMENT ALIGNMENT METHOD AND APPARATUS FOR DOCUMENT FEED EQUIPMENT

Figure 1:
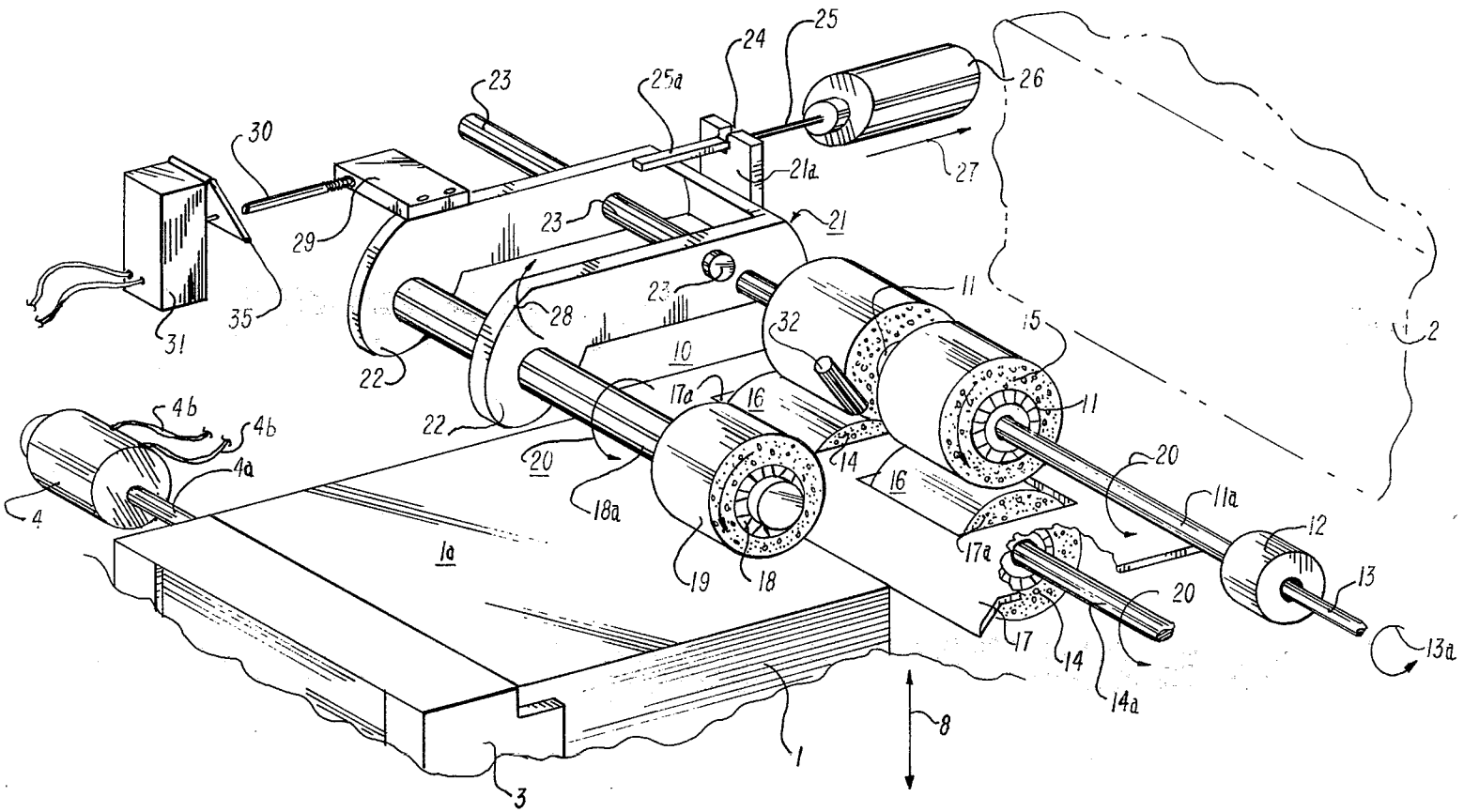

The present invention relates to document feeding, more particularly to a method and apparatus for feeding individual sheet-like documents from a stack, and even more particularly to apparatus for continually aligning the top of the stack of documents with a document separation mechanism.

As used throughout the following description and the claims, the term "documents" means and refers to sheet-like articles of a generally flexible nature; and would include, for example, paper, cards, and the like.

In many applications, such as photocopying, data processing, card sorting, etc., it is necessary to separately feed individual documents to the particular utilization apparatus from a supply of said documents arranged in a stack. One of the conventional and known methods for effecting this feeding operation is by way of an apparatus including a vertically movable platform for supporting the stack of documents, a feeding mechanism comprising rotatably powered cooperating separator and restraint rollers positioned to receive documents laterally fed from the top of the stack by a rotatably powered picker roller, and means for elevating the document support platform after depletion of a number of documents from the stack. The picker roller is normally pivotally mounted to enable it to maintain continuous contact with, and thus "follow", the top of the stack as each document is depleted therefrom until the roller drops below a predetermined level, at which time the platform is elevated to raise the stack to its original level.

While the aforementioned sheet feeding apparatus has generally served its intended purpose, there are many disadvantages associated with its operation. For example, since the support platform is not elevated until a number of documents are depleted from the top of the stack, the top of the stack is normally below, rather than laterally aligned with, the nip point of the separator and restraint rollers, thereby increasing the propensity that the documents will be crumpled during feed. This is particularly so when the documents may be very thin onion skin type paper. Furthermore, since most of the documents will be fed from the stack in other than a parallel direction thereto, the moving top sheet transmits driving friction forces to the underlying sheets, thereby feeding clumps, rather than single ones, of the documents to the separator-restraint roller assembly. Additionally, since the picker roller itself has dropped out of alignment with the restraint and separator rollers, the resulting angular relationship of the picker roller even further enhances the possibility of clump feeding.

It is therefore a principal object of the present invention to provide a new and improved method and apparatus for feeding documents.

It is another object of the invention to provide a new and improved apparatus for effectively feeding extremely thin sheet-like documents to utilization apparatus while minimizing the propensity of the documents to crumple.

It is a still further object of the invention to provide a new and improved means for maintaining continual lateral or coplanar alignment between the top of a stack of documents and the nip point of a roller feed assembly.

It is an even still further object of the invention to provide a new and improved method and apparatus for separately feeding individual documents to utilization apparatus from the top of a stack of said documents.

In accordance with these and other objects, the present invention is directed to a document feed method and apparatus for continually elevating a stack of documents after, and in response to, each document being fed to utilization apparatus so as to maintain substantial coplanar or lateral alignment between the top of the stack and the nip point of the roller assembly transporting the document to the utilization apparatus. More specifically, the present invention is directed to a document feed apparatus of the aforementioned type utilizing a picker roller for engaging and transporting the top document from the stack to a separator-restraint roller assembly wherein the picker roller is initially lifted from, and thereafter allowed to drop back to, the top of the stack in response to the leading and trailing edge of each document passing through the nip point of the roller assembly, the return of the picker roller to the stack effective to automatically elevate the stack of documents to reposition the top thereof in the desired lateral alignment with the roller assembly.

Additional features of the invention, as well as further objects and advantages thereof, will become readily apparent from the following detailed description, taken in conjunction with the accompanying drawings in which:

FIG. 1 is a pictorial illustration illustrating the details of the pertinent portions of the document feed apparatus of the present invention, and its cooperative relationship with the stack of documents to be selectively fed to utilization apparatus; and FIGS. 2A – 2D are diagrammatic representations illustrating the sequential operation of the apparatus illustrated in FIG. 1.

The drawings are not necessarily to scale, and in some instances portions have been exaggerated in order to emphasize the features of the invention.

Referring initially to FIG. 1, the document feed apparatus of the present invention includes a document separating and feed roller mechanism 10 for individually feeding the documents from the top of a stack 1 to utilization apparatus, the housing of which is represented in phantom and generally designated by the reference numeral 2. As previously mentioned, the documents may be flexible sheets of paper, cards, or like articles, the particular type of document depending upon the nature of the utilization apparatus 2. For example, the utilization apparatus may be one of a large variety of photocopying equipment in which event the stack of documents 1 would comprise blank sheets of copy material or suitably treated record medium. Alternatively, the documents may be checks, credit card receipts, or other commercial instruments bearing characteristic information indicia, the documents (and particularly the information on the documents) being suitably decoded, sorted, and processed by the apparatus 2.

The document stack 1 is normally contained within some type of a supply drawer or bin 3 and is supported at its base upon a vertically movable platform (not shown) effective to transport the stack in the direction of the arrow 8. The raising (and lowering) of the document support platform can be effected by any one of a number of automatic stack elevating mechanisms known in the art, the detailed construction and operation of such mechanisms not being described herein since they form no part of the present invention.

For the purpose of the present invention, it is only important to note that the stack elevating mechanism is driven by motive means, such as a reversible d-c motor 4, which rotary output shaft 4*a* is suitably connected with the stack elevating mechanism. Upon receipt of an electrical signal across its input leads 4*b* (from a motor control network, not illustrated), the motor 4 is actuated to elevate the document stack 1. The motor 4 may be of the conventional stepping type which rotates the shaft 4*a* in defined increments in response to respective pulses received from the motor control network; or alternatively, and for the purposes subsequently described, may continuously rotate the shaft 4*a* for so long as a voltage appears across its input. In either event, the extent of rotation of the shaft 4*a* elevates the document support platform (and stack 1) a proportional amount.

The separator-feed mechanism 10 includes a pair of separator rollers 11 spaced along, and mounted to rotate with, a rotatably driven shaft 11*a*. The separator shaft 11*a* is journaled for rotation in suitable bearings (not shown) and is adapted for operative coupling through a conventional clutch mechanism 12 with a drive shaft 13. The drive shaft 13 is continuously rotated in the direction of the arrow 13*a* by suitable drive means (not shown), such as an a-c motor; and, upon actuation of the clutch 12, rotatably powers shaft 11*a* in the same direction.

Located immediately below, and extending substantially parallel with, the separator shaft 11*a* is a shaft 14*a* journaled for rotation in suitable bearings (not shown), a pair of restraint rollers 14 longitudinally spaced along, and mounted to rotate with, the shaft 14*a*. The restraint rollers 14 are positioned along the shaft 14*a*, and extend through openings 17*a* of a document guide plate 17, so as to be in operative communication with the separator rollers 11 at respective locations generally referred to as the "nip points". Specifically, the separator and restraint rollers have friction surfaces 15 and 16 disposed around their respective circumferences, which either rotatably bear against one another at the nip points or are separated from one another at the nip points by a slight clearance space approximately equal to the thickness of the document to be advanced therethrough.

Extending substantially parallel to shafts 11*a* and 14*a* is a third shaft 18*a* having a picker roller 18 mounted to rotate therewith. The picker roller 18, having a circumferentially disposed friction surface 19 thereon, is effective, when rotatably engaging the document stack, to transport the top document 1*a* of the stack to the nip points of the restraint and separator rollers.

The shafts 11*a*, 14*a*, and 18*a* are appropriately interconnected, for example by way of a gear train (not shown), to simultaneously rotate in the same direction (direction of arrows 20) upon the actuation of clutch 12. Thus, and as is apparent from FIG. 1, the resulting rotation of picker roller 18 transports documents from the stack 1 to the nip points of the separator and restraint rollers; and the resulting counter-revolution between the separator and restraint rollers 11 and 14 tends to advance the top document toward the utilization apparatus 2, while driving any underlying documents which may have been transported to the nip points back toward the stack.

If necessary, and as is conventionally known, the respective gear ratios of the gear train interconnecting the shafts 11*a*, 14*a*, and 18*a* are chosen so that the separator rollers 11 have an angular velocity substantially greater than the angular velocity of the restraint rollers 14, and slightly greater than that of the picker roller 18. Additionally, and to further enhance separation, the coefficient of friction of the separator surfaces or pads 15 is normally substantially greater than the coefficient of friction of the pads 16.

The shaft 18*a* is supported by, and journaled for rotation within aligned openings in, a pair of arms 22 of a picker roller lift assembly 21. The entire assembly 21 is supportably mounted with, and is adapted to pivot around, a shaft 23, which is an extension of the shaft 11*a*, suitably secured with the apparatus housing. The lift assembly further includes an extension 21*a* having a notch 24 adapted to gripably engage the forward end 25*a* of a translatable plunger 25 associated with conventional solenoid means 26.

The solenoid 26 is effective, when energized, to withdraw the plunger 25 (in direction of arrow 27), thereby pivoting the entire lift assembly 21 (and coupled shaft 18*a*) in the clockwise direction indicated by arrow 28. If desired, stop means may be provided to engage the assembly 21 to limit the degree of such clockwise rotation. As a consequence of this pivotal movement, the picker roller 18 is lifted away from engagement with the document stack. Thereafter, when the solenoid 26 is deenergized, under the influence of the weight of the picker roller and shaft, the entire lift assembly 21 pivots in the counter-clockwise direction, dropping the roller 18 toward engagement with the document stack 1.

In accordance with a unique feature of the present invention, the previously described lifting and dropping of the picker roller is effected in response to, and after, the feeding of each document through the separator-restraint roller subassembly; and the dropping of the picker roller upon the top of the document stack 1 elevates the document support platform to continually reposition the top document 1*a* in substantial coplanar or lateral alignment with the nip points of the roller subassembly.

Specifically, the energizing and deenergizing of the solenoid 26 (and therefore the lifting and dropping of the picker roller 18) is by a control means having its output coupled with the solenoid and respectively responsive to the leading and trailing edges of each document passing through the nip points as it is transported to the utilization apparatus 2. Such control means would include a suitable sensor assembly, one example being the optical sensing portion 32 depicted in FIG. 1, focused or disposed at the nip point, the output of the sensor assembly coupled to an appropriate electronic control network (not shown) for energizing the solenoid.

The sensor 32 initially detects the leading edge of each document passing into the nip point, the associated electronic control network consequently producing a signal to energize the solenoid 26 to lift the picker roller away from the stack. Thereafter, as the trailing edge of the document passes through the nip point and is accordingly sensed by the sensor 32, the signal from the control network ceases, thus deenergizing the solenoid 26 and allowing the picker roller to drop toward the stack. The control network also disengages the clutch 12 (thereby interrupting the rotation of all rollers) when the trailing edge of the document passes through the restraint-separator rollers.

As previously described, the actuation of the motor 4 by an appropriate motor control network elevates the document support platform. In accordance with a feature of the present invention, the motor control network includes a switch disposed in a switch housing 31, the depression of a switch actuator assembly 35 associated therewith providing the requisite electrical pulses to initiate the operation of the motor.

Extending from the main body of the lift assembly 21 is an extension arm 29 having a projection 30 transversely connected therewith. The end of the projection 30 is so positioned to engage and depress the switch actuator assembly 35 whenever the extent of counter-clockwise pivotal movement of the lift assembly exceeds a predetermined amount. Specifically, as long as the bottom edge of the picker roller pad 19 is disposed approximately coplanar with, or above, the nip point of the separator and restraint rollers, the projection 30 is out of engagement with the assembly 35. The dropping of the picker roller (and particularly the friction pad 19) below this point, however, enables the end of the projection 30 to engage and depress the switch actuator assembly 35, thus actuating the motor 4 to elevate the document stack.

To maintain the desired spacing between the end of the projection 30 and the switch actuator 35 in order to accomplish the just described operation, particularly where the document feed apparatus is to be capable of feeding sets of documents of different thicknesses, it is desirable to have the projection 30 threadably, and therefore adjustably, connected to extension 29.

A full appreciation of the advantages inherent in the unique features of the just described document feed apparatus will be had by considering the following description of the overall operation of the apparatus, and specifically one complete feed cycle thereof.

Accordingly, the stack of documents to be fed is initially loaded on the vertically movable support platform which, at this time, would be at its lowermost position. Since the lift assembly 21 (and picker roller 18) would therefore be free to pivot at its lowermost position, the switch actuator 35 would be fully depressed by the projection 30; and the motor 4 would receive a continuous signal, or a continuous series of pulses, from the motor control network, thus rotating the shaft 4*a* to elevate the document support platform. The support platform (and document stack 1) will accordingly be elevated; and since the picker roller lift assembly rests upon the stack, it will consequently pivot until the projection 30 disengages from the switch actuator 35. At such time, the elevation of the platform ceases; and the document stack is in the position depicted in FIG. 2A with the top document 1*a* of the stack being positioned in substantial coplanar alignment with the nip point 9 of the separator and restraint rollers 11 and 14. For comparative purposes, the document immediately underlying the top document 1*a* has been given the reference designation 1*b*.

The feed cycle of the apparatus is not initiated by appropriate control circuitry which actuates the clutch 12 to rotatably power all rollers, including picker roller 18, which thus laterally translates the top document 1*a* toward the nip point 9. It is noted from FIG. 2A that during such time, the normal weight load of the picker roller at its interface with the stack generates a slight depression of the documents thereat.

Figure 2A:
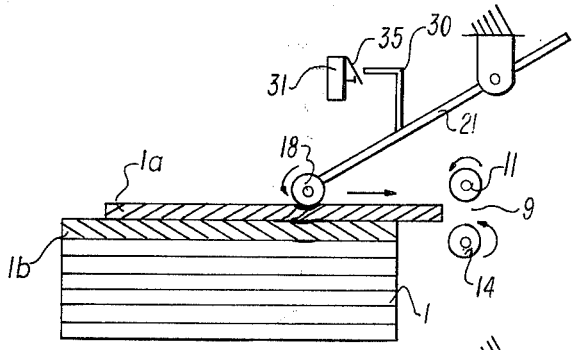
Figure 2B:
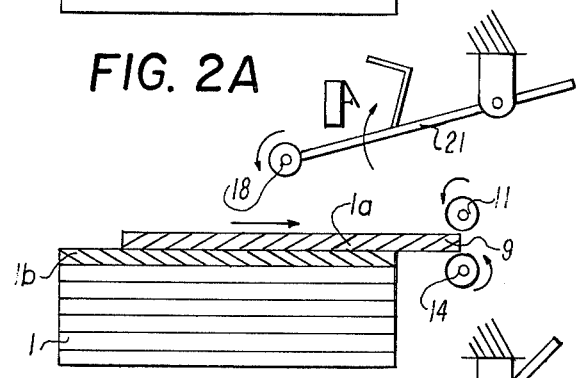

As the leading edge of the document 1*a* reaches the nip point 9, the sensor assembly, including sensor 32, actuates the solenoid 26 to pivot the picker roller 18 away from engagement with the document stack to the approximate position depicted in FIG. 2B. The document 1*a* is thereafter transported, under the principal influence of rollers 11, toward the utilization apparatus 2.

Figure 2C:
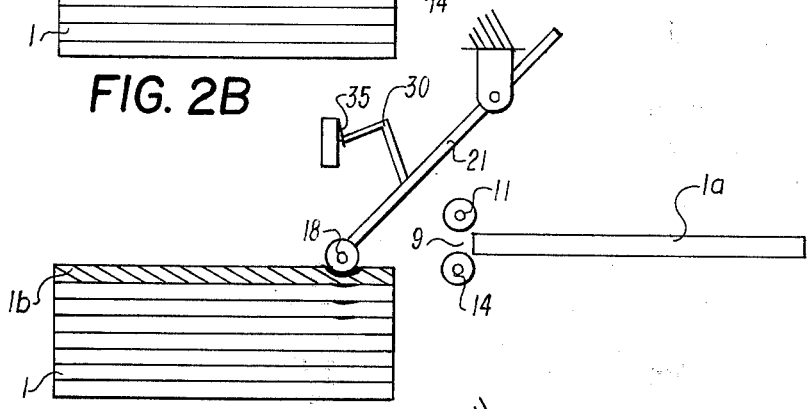
Figure 2D:
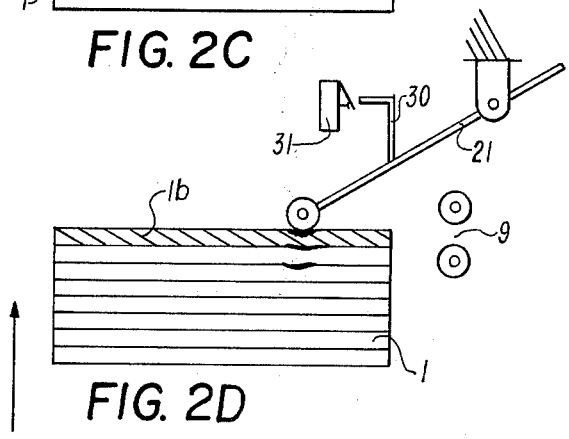

Thereafter, and as the trailing edge of the document 1*a* passes through the nip point 9, such event is detected by the sensor assembly and its associated control network to disengage the clutch mechanism 12 to terminate the rotation of all rollers. After a brief delay to insure that the rollers have ceased rotating, such control network deenergizes solenoid 26, thus allowing the assembly 21 to pivot in the counter-clockwise direction, dropping the picker roller 18 upon the top of the document stack, as shown in FIG. 2C. It is to be noted from FIG. 2C that, at this time, the document 1*b* is out of lateral alignment with nip point 9.

As a consequence of the momentum of the dropping picker roller, the document stack at the point of engagement by the picker roller 18 is initially depressed beyond the normal load depression shown in FIG. 2A, the resilient nature of the stack (and platform) thereafter immediately returning the picker roller to its normal load position. The extent of the initial depression of the stack, however, is sufficient to allow the projection 30 to momentarily engage and depress the switch actuator 35, the resulting "flicking" of the switch 31 then pulsing the motor 4. As a consequence, the motor shaft 4*a* is incrementally rotated to incrementally elevate the stack 1 (and particularly the next document 1*b*) to the position shown in FIG. 2D, the document 1*b* now being repositioned in substantial coplanar and lateral alignment with the nip point 9; and the just described feed cycle is again repeated.

It is thus observed that the apparatus and method of the present invention is effective to continually reposition the top document of the stack in substantial coplanar alignment with the separator-restraint roller nip point. Thus, the resulting document feed is always carried out in a lateral direction, thus minimizing the propensity of the documents to crumple, as well as the propensity for clump feeding. As a consequence, the importance of the reverse rotated restraint rollers 14 is reduced; and, if desired, such rollers can be replaced by fixed restraint pads. Additionally, and if clump feeding is still a concern, it is now possible to simply provide the guide plate 17 with a barrier strip of minimum height extending transverse to the direction of document feed and between the picker and separator rollers. Finally, the lifting of the picker roller during each feed cycle provides an additional advantage in that even the normal load on the document stack can be thus removed to periodically relieve any buckling of the document being fed that may occur as a consequence of the simultaneous engagement of the document by the picker and separator rollers.

Various modifications of the disclosed embodiment, as well as alternate embodiments of the invention, may become apparent to one skilled in the art without departing from the spirit and scope of the present invention as defined by the appended claims.

What is claimed is:

1. In apparatus for feeding documents from a stack and being of the type including a vertically movable platform for supporting said stack of documents, means for elevating said platform, a document feed assembly comprising a set of rotatably powered cooperating rollers and rotatably powered picker roller means pivotally mounted for respective disengagement from and engagement with said stack for advancing a document from said stack to the nip point of said cooperating rollers; the improvement wherein said apparatus further comprises a sensor assembly responsive to the leading edge of each document passing through said nip point for initially causing pivoting of said picker roller means out of engagement with said stack and further responsive to the trailing edge of each document to both interrupt the rotation of said cooperating rollers and allow said picker roller means to drop back into engagement with said stack and second means responsive to the momentum of said dropping picker roller means for incrementally elevating said document stack.

2. Document feed apparatus for separating and feeding documents to utilization apparatus from a stack of said documents, said document feed apparatus comprising:

a. vertically movable platform means for supporting said stack of documents;

b. document separating means for laterally translating and separating the topmost document from said stack, said document separating means comprising;

i. rotatably powered separator and restraint rollers cooperatively engaging one another at a nip location for translating documents from said stack toward said utilization apparatus, ii. rotatably powered picker roller means laterally translating the topmost document from said stack toward said nip location, and iii. lift assembly means for pivotally supporting said picker roller means between engagement with and disengagement from said document stack, c. first means responsive to each document passing through said nip location for initially pivoting said lift assembly to a first position and thereafter releasing said lift assembly from said first position, thereby to respectively raise said picker roller means from engagement with said stack and thereafter drop said picker roller means back into engagement with said stack;

d. a switch having an actuator assembly which, when depressably engaged, operates a motive means which, when operated, elevates said vertically movable platform means, said switch being actuated by the momentum of the dropping of said picker roller means a predetermined amount below coplanar alignment with said nip location; and e. said lift assembly comprises projection means adapted to depressably engage said actuator assembly when said roller means drops below said predetermined amount.

3. The apparatus as defined by claim 2 wherein said projection means is adjustably positionable with respect to said switch actuator assembly.

* * * * *